United States Patent [19]

Shibano et al.

[11] Patent Number: 4,887,090

[45] Date of Patent: Dec. 12, 1989

[54] VEHICLE ANTENNA WITH SHIFTABLE GAIN PATTERNS

[75] Inventors: Yoshizo Shibano; Haruo Suzuki; Tohru Iwai, all of Osaka, Japan

[73] Assignee: Sumitomo Electric Industries, Osaka, Japan

[21] Appl. No.: 105,374

[22] Filed: Oct. 7, 1987

[30] Foreign Application Priority Data

Oct. 7, 1986 [JP] Japan ..... 61-238298

[51] Int. Cl.[4] ..... H01Q 1/32; H01Q 3/30

[52] U.S. Cl. ..... 343/711; 343/713; 343/829; 343/853

[58] Field of Search ..... 343/700 MS, 702, 711–713, 343/829, 846, 853, 848, 908

[56] References Cited

U.S. PATENT DOCUMENTS 4,547,779 10/1985 Sanford et al. ..... 343/700 MS
4,701,763 10/1987 Yamamoto et al. ..... 343/700 MS

FOREIGN PATENT DOCUMENTS 126304 7/1984 Japan ..... 343/700 MS

OTHER PUBLICATIONS

Brain et al., "The Disc Antenna, A Possible L-Band Aircraft Antenna", Int'l Conf. on Sat. Syst. for Mobile Command Surveillance, Mar. 13–15, 1973, pp. 14–17.

Carver et al., "Microstrip Antenna Technology", *IEEE Trans. on Antenna Prop.,* vol. AP-29, No. 1, Jan. 1981, pp. 2–23.

*Primary Examiner*—Rolf Hille
*Assistant Examiner*—Michael C. Wimer
*Attorney, Agent, or Firm*—Sughrue, Mion, Zinn, Macpeak & Seas

[57] ABSTRACT

An antenna for vehicle mounting in a roadside beacon system comprising a ground plane, a shorting board transverse to the grounding plane and two antenna boards attached to the top of the shorting boards in parallel to the ground plane. Two signal feeding points are symmetrically placed in the ground plane on either side of the shorting board. Depending on whether the two signals are phase shifted with respect to each other the antenna gain pattern is directed sidewardly with high gain or upwardly with low gain.

9 Claims, 7 Drawing Sheets

VEHICLE ANTENNA WITH SHIFTABLE GAIN PATTERNS

BACKGROUND OF THE INVENTION

1. Field of the Invention

This invention relates to antennas, and more particularly to an antenna which is suitable as a data receiving mobile antenna in a navigation system which receives vehicle speed data and direction data to display the current position of the vehicle.

2. Background of the Invention

A so-called "navigation system" has been proposed in the art in which a small computer and a small display unit are installed on a vehicle. A road map is read out of memory means comprising a compact disk, for example, and is displayed on the display unit. According to vehicle speed data outputted by a vehicle speed sensor and direction data outputted by a direction sensor, the current position of the vehicle is calculated while the current travel direction of the vehicle is determined. Therefore, according to the result of calculation and the result of the direction determination, a mark indicating the vehicle is added to the road map displayed on the display unit.

With the navigation system, the present vehicle position and travel direction can be visually detected with ease and the driver can positively reach his destination without losing his way.

However, the above-described navigation system suffers from the following difficulty. The errors inherent in the vehicle speed sensor and the direction sensor are accumulated as the travel distance increases. Therefore, when the travel distance reaches a predetermined value, the vehicle position displayed on the display unit deviates greatly from the true vehicle position. That is, the navigation system is unreliable, and the driver may lose his way. The predetermined travel distance at which positional accuracy is lost is not always constant, because it is determined according to the degrees of errors of the vehicle speed sensor and the direction sensor of a vehicle, variations in the environmental conditions of the installed sensors, and so forth.

For the purpose of eliminating the above-described difficulty, a so-called "roadside beacon system" has been proposed in the art. In the system, roadside antennas are installed along a road at predetermined intervals shorter than the distance which is known to cause the above-described errors to be accumulated to predetermined critical values. A signal containing position data and road direction data is radiated over a relatively small area by each of the roadside antennas and is received by a mobile antenna installed on a vehicle so that it is applied to a computer. Then, the vehicle position and travel direction are calibrated according to the signal thus received.

In the roadside beacon system, the display is made on the basis of correct position data and direction data with the accumulations of the errors maintained smaller than the predetermined critical values. This will allow the navigation system to operate as expected. Furthermore, the roadside beacon system is advantageous in that, if the roadside antennas are installed at the positions such as those near railroads or crossings where a large error is liable to occur with the direction sensor, then errors attributed to external factors can be effectively eliminated through calibration.

In the above-described roadside beacon system, the roadside antennas with considerably high directivity radiate signals containing position data and road direction data at all times. The signals are received only when the vehicle passes through the areas covered by the signals thus radiated so that necessary calibrations are carried out according to the signals thus received. Therefore, the system is still disadvantageous in that, if each area covered by the signals is increased, a signal receiving position will deviate greatly from the position of the respective roadside antenna with the result that the calibrations cannot be achieved effectively.

The fundamental function of the roadside beacon system is to apply the signal containing position data and road direction data to a vehicle with the navigation system. However, for the more effective use of the roadside beacon system, it is desired to add the following functions to the fundamental function described above.

(1) Traffic data such as traffic congestion, and construction and use of roads in the vicinity of the roadside antenna are transmitted to the navigation system so that the vehicle may travel smoothly.

(2) Detailed map data including the arrangement of houses with residents' names near the roadside antenna are added so that the vehicle can readily reach its local destination.

(3) Road map data covering a relatively wide area including roadside antennas installed are additionally transmitted to the navigation system, to thereby renew the road map displayed on the display unit so that the vehicle is smoothly directed to its distant destination.

These functions cannot be added without an increase in the transmission bandwidth of the signal radiated by the roadside antenna or an increase in the area covered by the transmitted signal.

However, when the transmission bandwidth of the signal radiated by the roadside antenna and the area covered by the transmitted signal are increased, the deviation of the signal receiving position from the position of the roadside antenna is so increased that the original object, i.e., the calibration of the vehicle position cannot accurately be achieved.

On the other hand, as the vehicle moves on, the positions of buildings or other vehicles relative thereto change, or there are different building arrangements or different vehicle traveling conditions for different roadside antennas. Accordingly, as shown in FIG. 1, the signal transmitted through the roadside antenna is received directly by the mobile antenna, but, on the other hand, is also received thereby after being reflected by a building, road surface or another vehicle. These signals, propagating along different paths, are different both in amplitude and in phase. Therefore, the signals are superposed on one another in phase or out of phase and the resultant signal is much different in signal strength distribution from the original signal transmitted through the roadside antenna as shown in FIG. 2. That is multipath fading. As a result, the calibration of the vehicle position according to the resultant signal involves an unexpected error. In other words, the resultant signal may have a high level at a position which is considerably away from the roadside antenna and, therefore, the vehicle position and travel direction may be calibrated when the high level is detected at the wrong place.

This difficulty may be eliminated by use of a low-pass filter. That is, the effect of the fading phenomenon on the received signal strength distribution may be eliminated by the provision of the low-pass filter.

The period of signal strength variation due to the fading phenomenon is, in general, in a range of from several tens of hertz (Hz) to 100 Hz. The low-pass filter should have a cutoff frequency of the order of several hertz (Hz). Formation of such a low-pass filter with passive circuits requires large inductance and large capacitance. This requirement makes it difficult to miniaturize the low-pass filter, although it should be installed on a vehicle. If the low-pass filter is made up of an active filter, then it may be miniaturized. However, the method is still disadvantageous in that the number of components is increased, and the circuitry is intricate, with the result that the mobile device is unavoidably high in manufacturing cost.

SUMMARY OF THE INVENTION

In view of the foregoing, an object of this invention is to provide an antenna which readily allows the addition of the above-described functions to the roadside beacon system and the performance of the original function of the system with high accuracy.

The foregoing object of the invention has been achieved by the provision of an antenna which, according to the invention, comprises: a ground plane, a short circuit board and a pair of antenna boards equal in configuration which are connected through the short-circuit board to the ground plane in such a manner that the antenna boards are extended in opposite direction in parallel with the ground plane. Feeding points are provided between the ground plane and the antenna boards in such a manner that the feeding points are positioned symmetrically with respect to the short-circuit board.

In the antenna of the invention, the pair of antenna boards may be formed into one unit. Additionally, each of the antenna boards may be square or semi-circular. Furthermore, in the antenna of the invention, signals in phase with each other or 180° out of phase may be applied to the feeding points.

The antenna of the invention may be used as a mobile antenna.

When signals held in predetermined phase relation are applied to the feeding points of the antenna thus constructed, radio waves can be received with the radiation directivity determined by the phase relation.

The antenna operates in the same manner in the case also where the pair of antenna boards are formed into one unit.

The same function can be obtained when the antenna boards not are only square but also when they are semi-circular.

When signals in phase with each other are supplied to the feeding points, the radiation directivity of the antenna is such that the main radiation direction is substantially perpendicular to the short-circuit board in a plane perpendicular to the antenna boards, and the antenna is substantially omni-directional in a plane in parallel with the antenna boards. When signals 180° out of phase are supplied to the feeding points, the radiation directivity is such that a radiation beam is formed in a direction perpendicular to the antenna boards.

In the case where the antenna of the invention is used as a mobile antenna in the roadside beacon system, signals in phase with each other are supplied to the feeding points, so that signals for data transmission can be received over a wide range. Then, signals 180° out of phase are applied to the feeding points so that signals for positioning can be received only at a position where the vehicle substantially confronts the roadside antenna, with the result that the vehicle position can be detected with high accuracy.

DETAILED DESCRIPTION OF THE PREFERRED EMBODIMENT

Preferred embodiments of the invention will be described with reference to the accompanying drawings.

Figure 3:
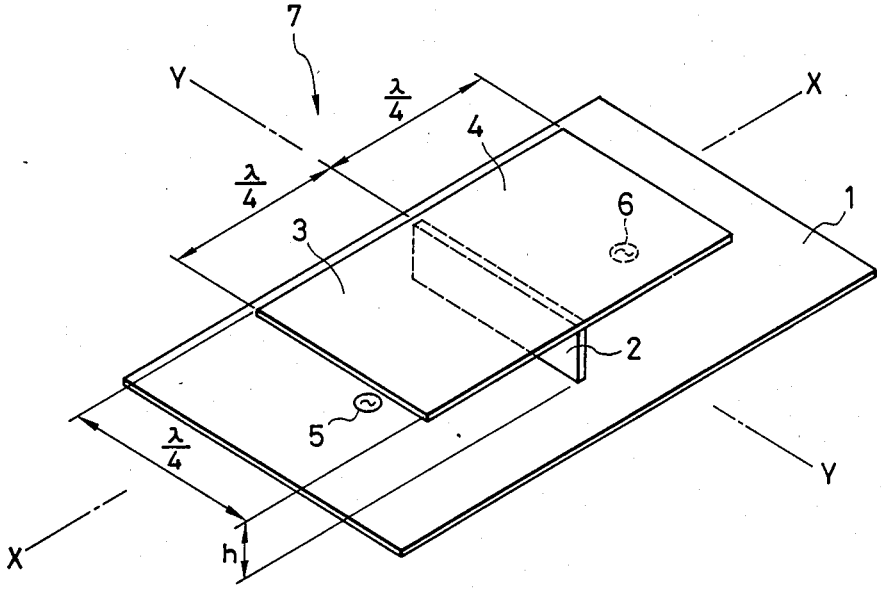
FIG. 3 is a perspective view showing one example of an antenna according to this invention.

FIG. 3 is a perspective view showing one example of an antenna according to the invention. Antenna boards 3 and 4 having one and the same configuration are connected through a short-circuit (shorting) board 2 to a ground plane 1 in such a manner that the antenna boards 3 and 4 extend in parallel with the ground plane 1 and in the opposite directions. Feeding points 5 and 6 are provided on the ground plane 1 at positions symmetrical with respect to the shorting board 2 for feeding electrical signals between the ground plane 1 and the antenna boards 3 and 4.

The configuration of each of the antenna boards is a square, the sides of which are substantially equal in length to a quarter of the wavelength used. The distance between the antenna board and the ground plane 1 is smaller than the wavelength.

Figure 4B:
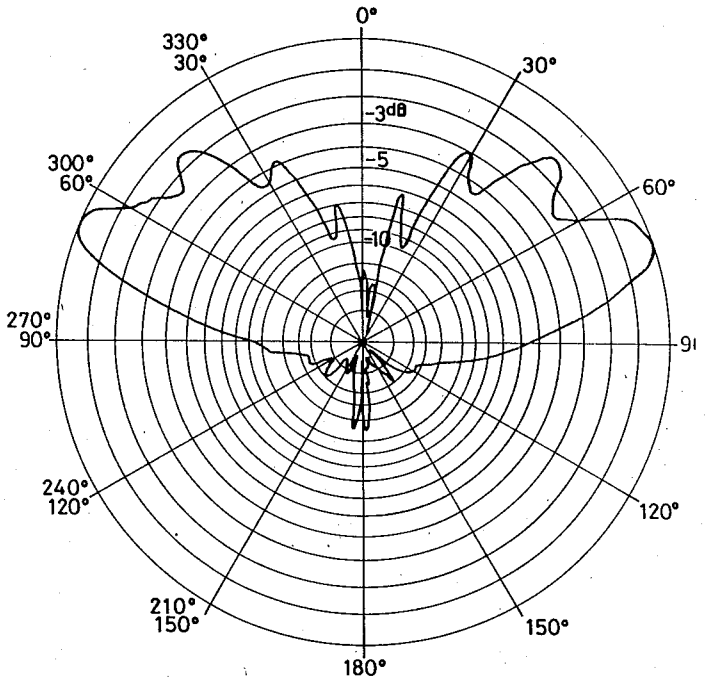
FIGS. 4A through 4E are diagrams showing radiation directional patterns of the antenna according to the invention.
Figure 4A:
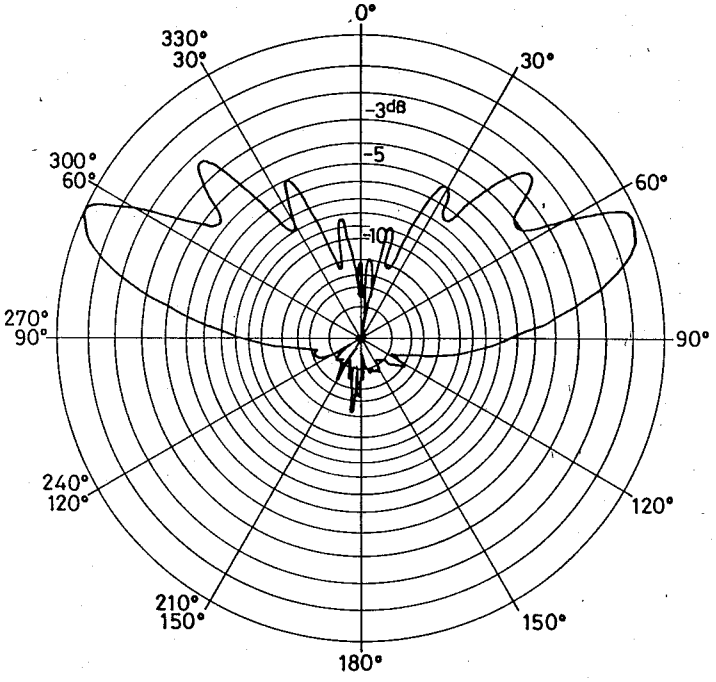
Figure 4D:
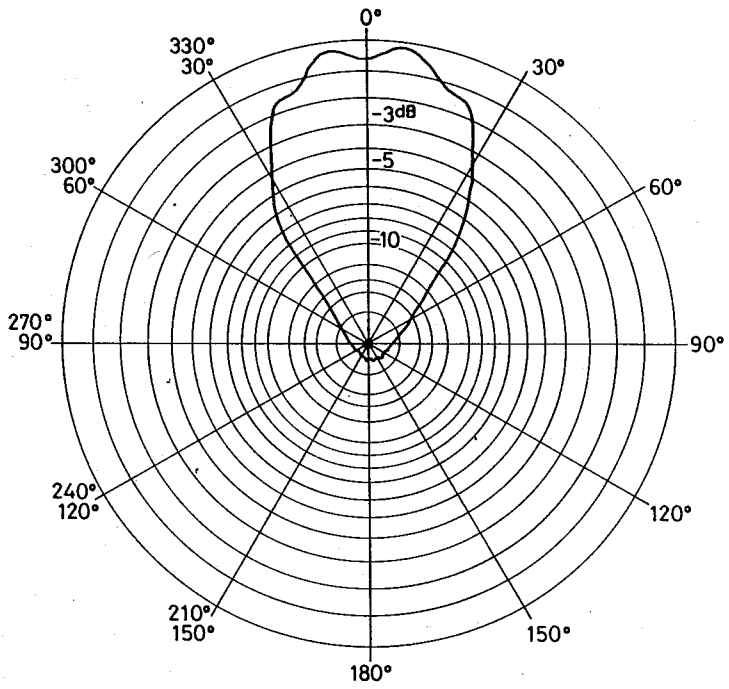
Figure 4C:
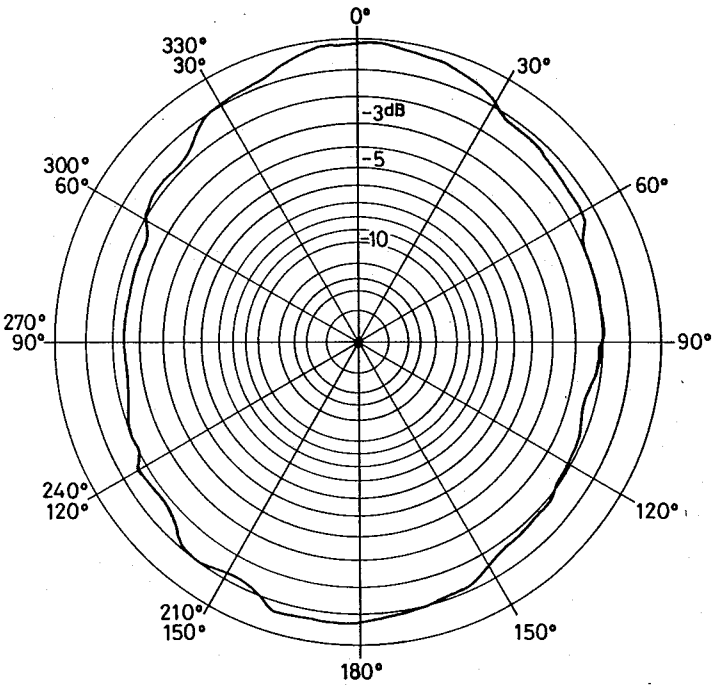

FIGS. 4A through 4C show radiation directional patterns of the above-described antenna. When signals in phase with each other are supplied through the feeding points 5 and 6, the radiation directivity is such that, as is apparent from FIGS. 4A through 4C, the main radiation direction is substantially perpendicular to the shorting board 2 in a plane perpendicular to the antenna boards and the antenna is substantially non-directional in a plane in parallel with the antenna boards. However, when signals 180° out of phase are supplied, the radiation directivity is such that, as shown in FIGS. 4D and 4E, a radiation beam is formed in a direction perpendicular to the antenna boards.

Figure 4E:
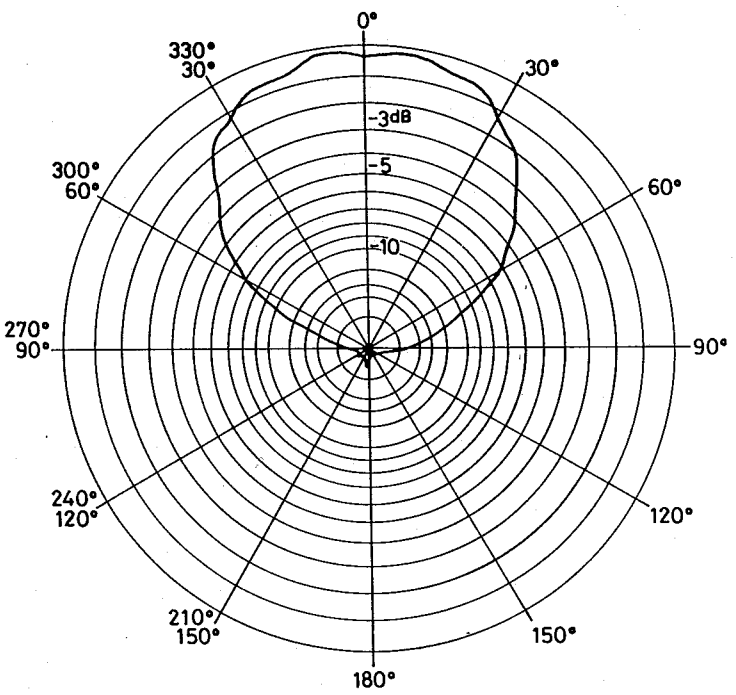

FIGS. 4A and 4E show field strength distributions in a plane (plane Y—Y in FIG. 3) in parallel with the shorting board 2. FIGS. 4B and 4D show field strength distributions in a plane (plane X—X in FIG. 3) including the two feeding points 5 and 6. FIG. 4C shows a field strength distribution in a plane in parallel with the antenna boards. The above-described field strength distributions were measured with the antenna installed on a metal disk 1 m in diameter representing the roof of a vehicle.

As was described above, when first signals in-phase with each other and second signals 180° out-of-phase are supplied to the feeding points 5 and 6, the radiation directivity as shown in FIGS. 4A through 4C is obtained for the in-phase signals, and the radiation directivity as shown in FIGS. 4D and 4E is provided for the out-of-phase signals.

Thus, when the radiation directivity with the in-phase signals is employed for data transmission, the data transmission region can increased. But when the radiation directivity with the out-of-phase signals is employed for positioning, the position determination can be achieved with high accuracy.

It is preferable to minimize the interference of the in-phase and out-of-phase signals, for instance, by amplitude-modulating the in-phase signals and subjecting the out-of-phase signals to constant-amplitude modulation.

Figure 5:
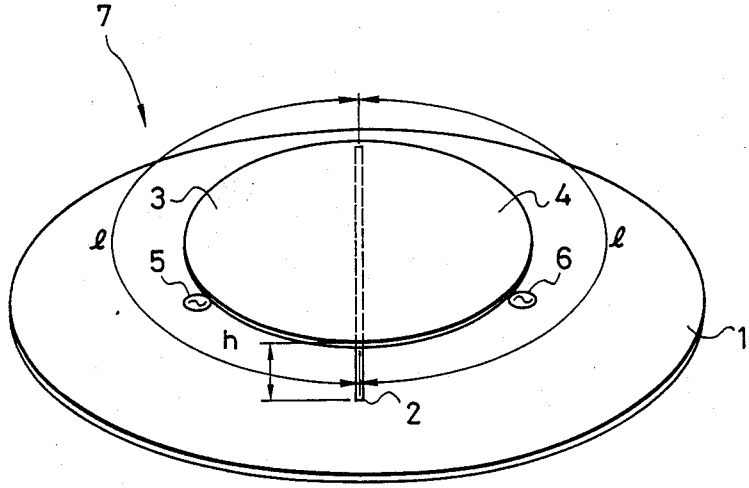
FIG. 5 is a perspective view showing another example of the antenna according to the invention.

FIG. 5 is a perspective view showing a second example of the antenna according to the invention. The antenna of FIG. 5 is different from that of FIG. 5 only in that semi-circular antenna boards are connected to a short-circuit board 2 in such a manner that the antenna boards thus connected are circular as a whole. The length of the arc of each of the antenna boards is substantially equal to one wavelength.

Also in the second example of the antenna, when signals in phase with each other are supplied to the feeding points, its radiation directivity is such that the main radiation direction is substantially perpendicular to the short-circuit board 2 in a plane perpendicular to the antenna board and the antenna is substantially non-directional in a plane in parallel with the antenna board. When signals 180° out of phase are supplied to the feeding points in this embodiment, the radiation directivity is such that a radiation beam is formed in a direction perpendicular to the antenna boards.

Now, the use of the antenna of the invention as a mobile antenna 7 in the roadside beacon system will be described.

Figure 6:
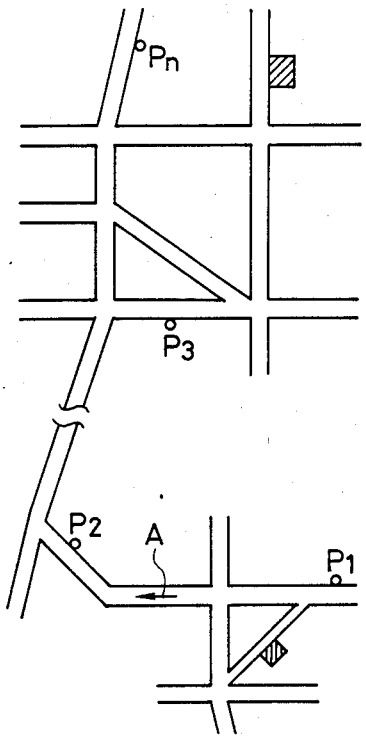
FIG. 6 is a diagram showing one example of a road map displayed on a display unit in the roadside beacon system.

FIG. 6 is a diagram outlining a road map displayed on a display unit. In the diagram, the present position and travel direction of a vehicle is indicated by the arrow A. Roadside antennas $P_1$, $P_2$, and $P_n$ are displayed in correspondence to their actual positions. However, it is not always necessary to display the roadside antennas in the roadside beacon system. Buildings, etc. (not shown) are displayed as guides on the display unit.

Figure 7:
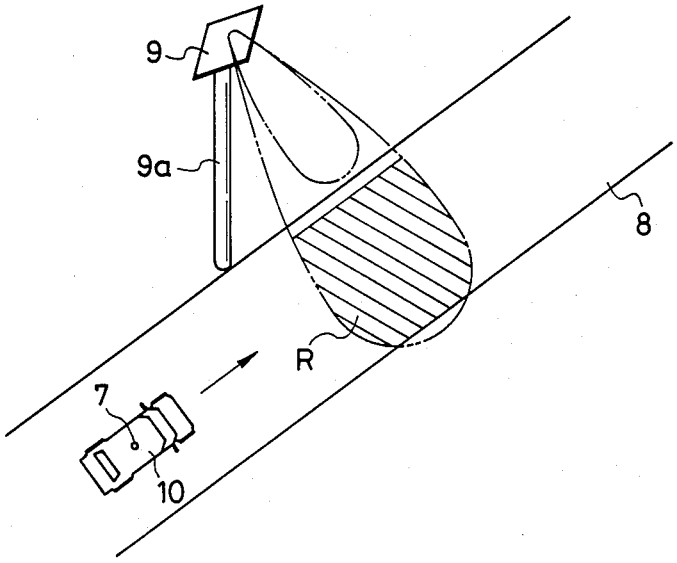
FIG. 7 is an explanatory diagram for a description of a roadside beacon system.

FIG. 7 is an explanatory diagram for a description of the roadside beacon system. A roadside antenna 9 for transmitting position data and road direction data is installed at a predetermined position beside a road 8. A mobile antenna 7 is installed on a vehicle 10 which travels along the road 8, to receive signals transmitted from the roadside antenna 9. The signals thus received is supplied to a navigation device (not shown) on the vehicle. The antenna as shown in FIG. 3 or 5 is used as the mobile antenna 7, as was described above.

The roadside antenna 9 is not so high in directivity in order to cover a relatively large area R as shown in FIG. 7.

Figure 8:
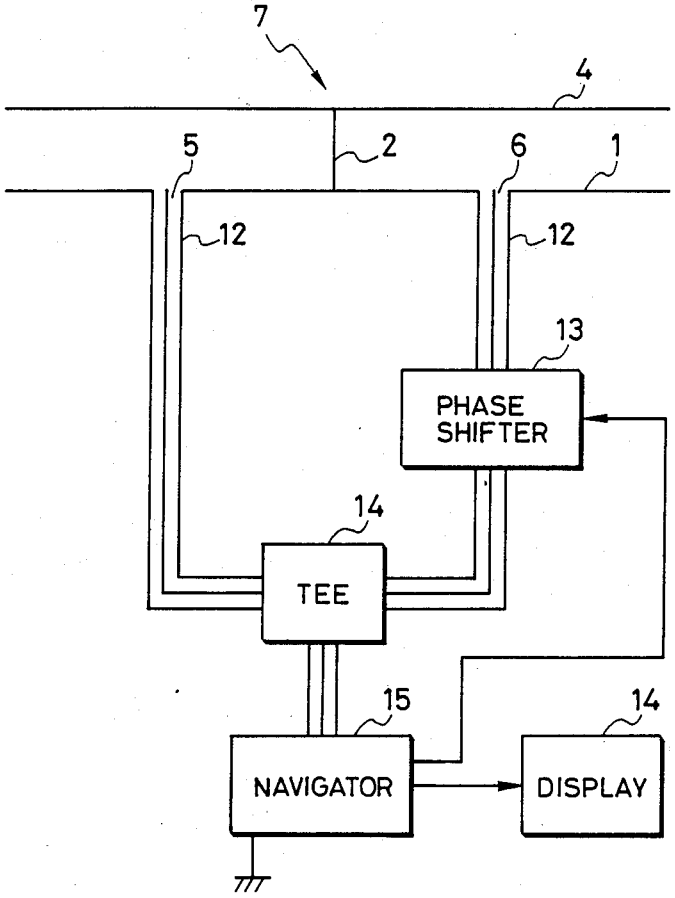
FIG. 8 is a schematic diagram of the vehicle mounted antenna and the on board navigation system.

FIG. 8 is an example of schematic diagram of the vehicle mounted navigation system. The antenna 7 on top of the vehicle receives signals from the roadside beacon and received signal is thereby transmitted through two coaxial cables 12. One of the split signals is applied to a phase shifter 13 which either passes the signal as it is or shifts its phase by 180°. The two signals are recombined in a tee 14 and applied to an on-board navigator (or signal processor) 15 with a display 16. The navigator 15 controls the phase shifter 13 dependent on whether the antenna gain pattern of FIG. 4A or of FIG. 4D is desired. Other feed systems can be used, for example, a hybrid network.

Figure 1:
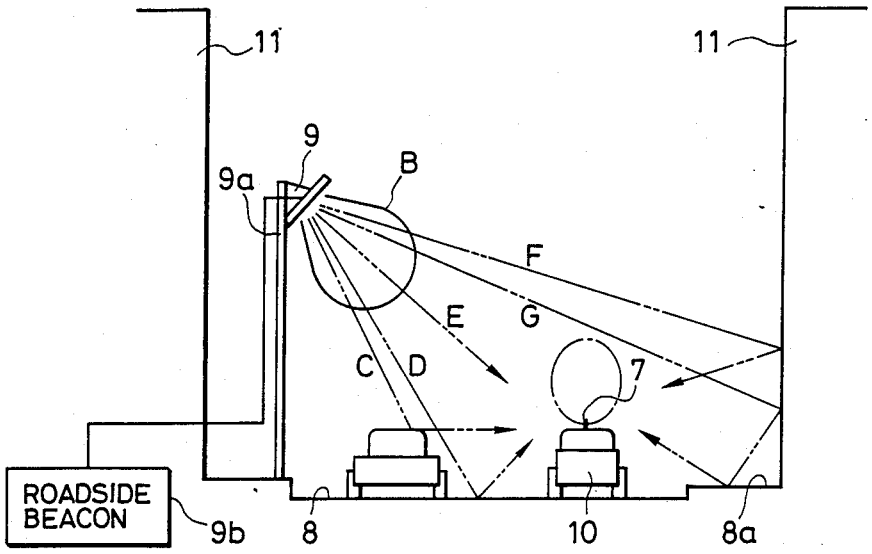
FIG. 1 is an explanatory diagram showing relationship between a roadside antenna and a mobile antenna.
Figure 2:
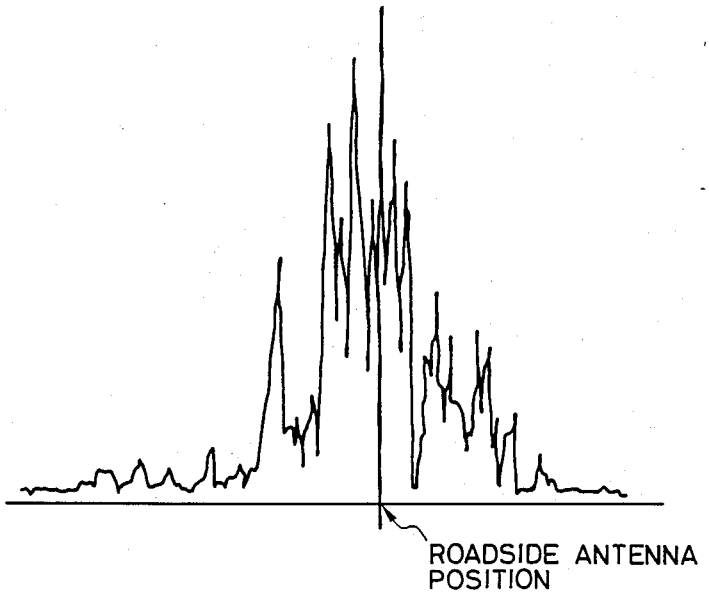
FIG. 2 is a wave form diagram showing a signal received in a conventional roadside beacon system.

FIG. 1 is a diagram showing the relationship between the roadside antenna 9 and the mobile antenna 7 in detail. The roadside antenna 9 is mounted on top of a post **9*a* near the road 8 in such a manner that the antenna 9 is much higher than large vehicles such as buses and trucks. A roadside beacon transmitter 9*b* supplies signals to the roadside antenna 9 for both the position data and the additional map and traffic data. The mobile antenna 7 constructed as shown in FIGS. 3 or 5 is installed on the roof of the vehicle 10**.

The roadside antenna 9 is not so high in directivity as indicated at B in FIG. 1, and is mounted on the post **9*a*** so as to transmit signals in all directions including a vertically downward direction.

Accordingly, part of the signal transmitted by the roadside antenna is reflected by the roof of another vehicle to the mobile antenna 7 as indicated by reference character C in FIG. 1, or it is reflected by the surface of the road to the mobile antenna 7 as indicated by reference character D in FIG. 1. Furthermore, part of the signal thus transmitted reaches the mobile antenna 7 directly as indicated by reference character E in FIG. 1. Moreover, a part of the signal is reflected by a building 11 to the mobile antenna 7 as indicated by reference character F or it is reflected by the building 11 and a road shoulder **8*a* to the mobile antenna 7** as indicated by reference character G.

In other words, the signal E is applied to the mobile antenna 7 from above, the signals C and F are sent substantially horizontally to the antenna 7, and the signals D and G are applied to the antenna 7 from below.

The signals C through G as was described above are received by the mobile antenna 7. In this operation, the mobile antenna 7 is made to have an upward-beam shaped directional pattern by signals 180° out of phase which are supplied to the feeding points 5 and 6. As a result, its sensitivity is greatly lowered in the directions of transmission of the signals C, D, F and G. That is, the signals C, D, F and G are scarcely supplied to the mobile device (not shown). Because of the upward-beam-shaped directional pattern, the signal E is strongly received by the mobile antenna and is therefore effectively supplied to the mobile device.

Although the signals transmitted by the roadside antenna 9 are sent along multiple paths to the mobile antenna 7, only the signal E is received by the antenna 7 with high sensitivity, whereas the remaining signals C, D, F and G are received with extremely low sensitivity. That is, only the signal E is effectively supplied to the mobile device. And the signal E is received strongly only when it is radiated substantially in agreement with the upward-beam-shaped directional pattern (or when the vehicle 10 confronts substantially with the roadside antenna 9). Therefore, when the level of the signal E thus received exceeds a predetermined reference value, it can be determined that the vehicle 10 is in confrontation with the roadside antenna.

As was described above, with signals in phase with each other supplied to the feeding points 5 and 6 of the mobile antenna 7, the mobile antenna 7 is made to have the radiation directivity in . which the main radiation direction is substantially perpendicular to the short-circuit board in the plane perpendicular to the antenna boards and the antenna is substantially omni-directional in the plane parallel with the antenna boards, so that the sensitivity to the signals C, D and G is greatly lowered and the signals C, D and G are not supplied to the mobile device. On the other hand, the sensitivity to the signal E is relatively high. However, the signal F from the roadside antenna is low in level and propagates for a relatively long distance, and therefore the signal F received by the mobile antenna 7 is considerably low. The directivity of the mobile antenna to the signal E is considerably high, and the distance of propagation of the signal E is relatively short. Therefore, the signal E is received with high sensitivity, and supplied to the mobile device with high efficiency.

Thus, in conclusion, of the signals transmitted along multiple paths to the mobile antenna, only the signal E is received by the antenna 7 with high sensitivity, and the remaining signals C, D, F and G are received with extremely low sensitivity. Therefore, only the signal E is supplied to the mobile device. Since the mobile antenna is non-directional in horizontal directions, the signal E is received thereby with high sensitivity when the vehicle 10 is located in a predetermined area around the roadside antenna 9. Therefore, when the level of the signal E thus received exceeds the predetermined value, the necessary data can be detected over a wide range.

Thus, the mobile antenna 7 receive only the signal E with high sensitivity which is transmitted with considerably high intensity. That is, the remaining signals are received at the levels which can be substantially disregarded. Accordingly, with the antenna of the invention, the data reception and the position determination can be achieved under the conditions that the multipath fading is effectively suppressed and the possibility of error extremely decreased.

Upon determination of the vehicle position, in the navigation device (not shown) the displayed vehicle position and travel direction can be calibrated according to the position data and road direction data included in the received signal, whereby the navigation can be carried out according to the data thus calibrated.

While the preferred embodiment has been described, the invention is not limited thereto or thereby. For instance when the technical concept of the invention is applied to the case where, in a system other than the road side beacon system, it is required to change the directivity of a receiving antenna, the desired directivity can be readily obtained. That is, various changes and modifications may be made in the embodiment without departing from the invention.

As was described above, in the antenna of the invention, the phases of signals applied to the feeding points of the pair of antenna boards connected commonly through the shorting board to the ground plane are set to predetermined values for determination of its directional pattern. Therefore, the desired directional pattern can be readily obtained merely by changing the phases of the signals applied to the feeding points with the physical construction of the antenna maintained unchanged.

What is claimed is:

1. A vehicle antenna comprising:

ground plane means;

short-circuit board means being mounted to said ground plane means in a substantially perpendicular manner;

antenna board means being mounted to said short-circuit board means such that a major plane of said antenna board means is divided into first and second antenna board portions which are substantially symmetrical about said short-circuit board means and which are substantially parallel to said ground plane means, said antenna board means being electrically connected to said ground plane means through an electrical conduction path provided by said short-circuit board;

means for receiving signals from a first signal feeding point on said first antenna board portion, and means for receiving signals from a second signal feeding point on said second antenna board portion, said signal feeding points being positioned symmetrically with respect to said short-circuit board means; and signal processing means for selectively processing either signals from said first and second signal feeding points which have a first phase relationship to obtain a first directivity pattern for said antenna or signals from said first and second feeding points which have a second phase relationship to obtain a second directivity pattern for said antenna.

2. A vehicle antenna as claimed in claim 1, wherein said antenna board means is formed as a unitary structure.

3. A vehicle antenna as claimed in claim 1, wherein said antenna board means has a substantially rectangular configuration, and wherein said first and second antenna board portions have a substantially square configuration.

4. A vehicle antenna as claimed in claim 1, wherein said antenna board means has a substantially circular configuration.

5. A vehicle antenna as claimed in claim 1, wherein said signals are provided to said signal processing means in phase with each other.

6. A vehicle antenna as claimed in claim 1, further comprising:

phase shifting means for shifting phases of signals from said signal feeding points by 180° relative to each other; and wherein said signal processing means processes signals produced by said phase shifting means.

7. A vehicle antenna as claimed in claim 6, wherein said phase shifting means selectively shifts said phases by 0° and 180° in response to a control signal from said processing means.

8. A vehicle antenna as claimed in claim 7, wherein said vehicle antenna is utilized in conjunction with a vehicle antenna system, said vehicle antenna system comprising roadside beacon antennas for transmitting signals to said vehicle antenna, and wherein said vehicle antenna is mounted on a movable road vehicle.

9. A vehicle antenna as claimed in claim 1, wherein said vehicle antenna is utilized in conjunction with a vehicle antenna system, said vehicle antenna system comprising roadside beacon antennas for transmitting signals to said vehicle antenna, and wherein said vehicle antenna is mounted on a movable road vehicle.

* * * * *